US009909270B1

(12) United States Patent
Bonifacio et al.

(10) Patent No.: US 9,909,270 B1
(45) Date of Patent: Mar. 6, 2018

(54) SIGN POST COVER

(71) Applicant: Futura SM, Inc., Hallandale Beach, FL (US)

(72) Inventors: Mauricio Bonifacio, Hallandale Beach, FL (US); Shlomo Eizenberger, Hallandale Beach, FL (US)

( * ) Notice: Subject to any disclaimer, the term of this patent is extended or adjusted under 35 U.S.C. 154(b) by 0 days.

(21) Appl. No.: 15/621,915

(22) Filed: Jun. 13, 2017

(51) Int. Cl.

| | |
|---|---|
| ***E01F 9/619*** | (2016.01) |
| ***G09F 13/16*** | (2006.01) |
| *G09F 13/14* | (2006.01) |
| *E01F 9/658* | (2016.01) |

(52) U.S. Cl.
CPC ..... *E01F 9/619* (2016.02); *G09F 13/16* (2013.01); *E01F 9/658* (2016.02); *G09F 2013/142* (2013.01)

(58) Field of Classification Search
CPC ..... E01F 9/619; G09F 13/16
See application file for complete search history.

(56) References Cited

U.S. PATENT DOCUMENTS

| | | | | |
|---|---|---|---|---|
| 2,275,518 | A * | 3/1942 | Frank | E01F 9/619 359/544 |
| 2,779,240 | A * | 1/1957 | Gaydos | E01F 9/608 359/514 |
| 4,152,046 | A * | 5/1979 | Knapp | G02B 5/124 359/514 |
| 4,620,636 | A * | 11/1986 | Herr | B42F 7/12 211/11 |
| 4,779,955 | A * | 10/1988 | Schmanski | E01F 9/619 116/63 R |
| 5,323,583 | A * | 6/1994 | Venegas, Jr. | E01F 15/003 256/1 |
| 5,731,895 | A * | 3/1998 | Owczarzak | E01F 9/619 116/63 R |
| 2014/0293421 | A1* | 10/2014 | Brandes | G02B 5/12 359/552 |

* cited by examiner

*Primary Examiner* — Gary C Hoge
(74) *Attorney, Agent, or Firm* — Christopher J Vandam, PA; Chris Vandam

(57) ABSTRACT

A sign post cover comprised of a series of segments that are stacked fit around a traffic control sign post. Segments have on a side facing the same direction as the sign on the sign post differing visual patterns that alternate between successive segments. A rear side of each segment includes an alternate pattern. This allows an observer from any direction to determine the nature of the sign and the direction which that sign faces.

4 Claims, 6 Drawing Sheets

SIGN POST COVER

BACKGROUND OF THE INVENTION

1. Field of the Invention

The present invention relates to traffic control signage, and more particularly, to a covering over the post of a sign for visual advantages, among other benefits.

2. Description of the Related Art

Several designs for traffic control signs have been designed in the past. None of them, however, includes a cover for the sign post with specific coloring and patterns that are relative to the viewing angle of the driver relative to the face of the sign.

Applicant believes that the closest reference corresponds current street signs, traffic barriers and traffic control devices that use reflective surfaces to capture the attention of a user at night. However, it differs from the present invention because none of the known prior art uses directionality to convey meaning to a driver with patterns that are visibly different depending on the angle of viewing incidence. This can help inform a driver from which direction she is approaching a sign. For example, this may be helpful to a driver to determine whether there is a stop sign for cross traffic at an intersection.

Other prior art describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a sign post with additional information to a driver to allow him to make better driving decisions.

It is another object of this invention to provide a sign post that is able to convey its meaning even if partially obscured or defaced.

It is still another object of the present invention to provide a sign post that is able to be retrofitted easily onto the wide variety of existing traffic and informational control signs.

It is yet another object of this invention to provide such a device and method of use that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
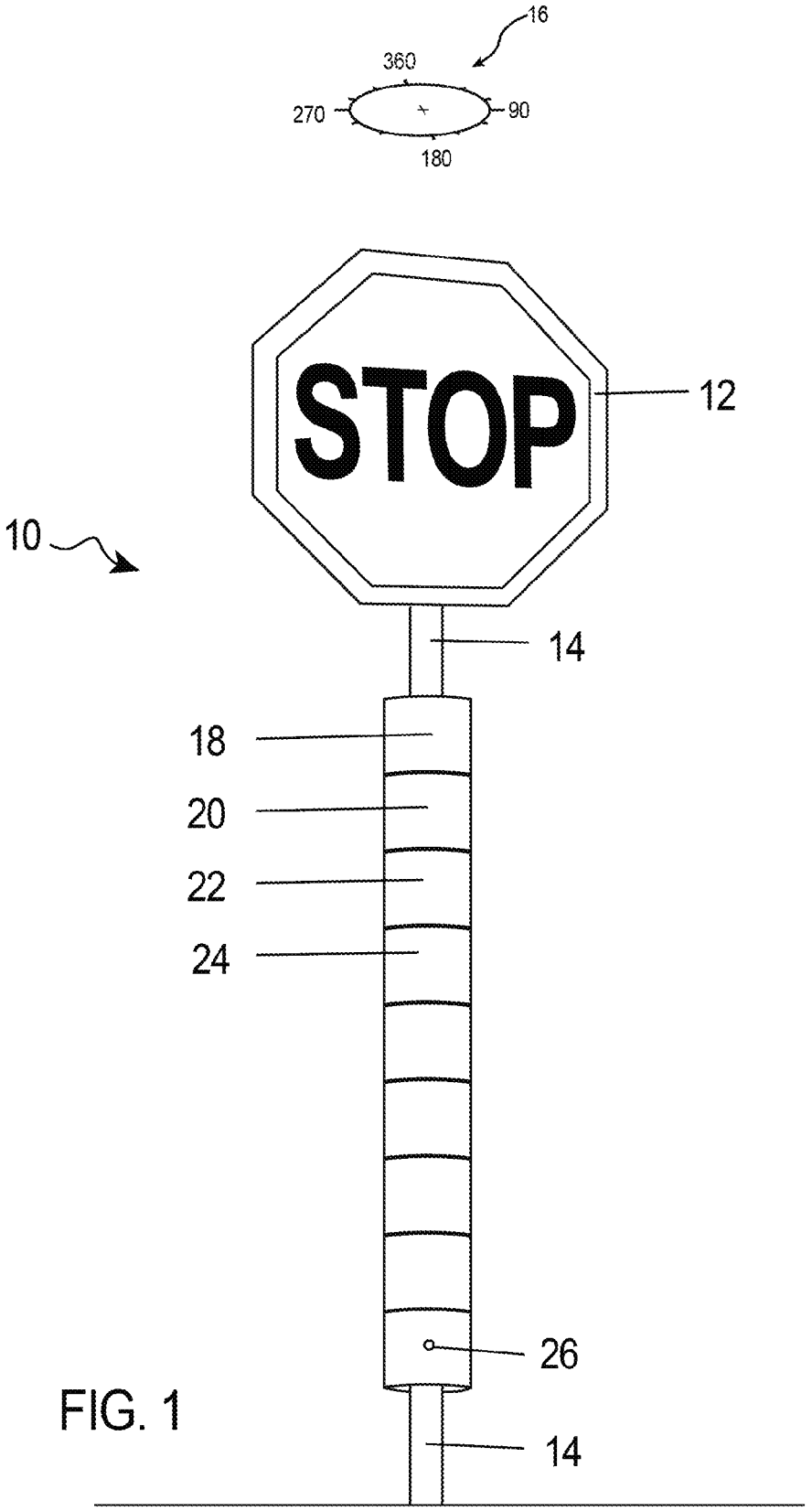
FIG. 1 shows a perspective view of a sign with a sign post cover installed.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the sign post cover, the pole cover, the cover, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

The disclosure and drawings enable on of ordinary skill to make and use the device without further extraordinary experimentation. The drawings are somewhat stylized to emphasize features, components and use to facilitate an easier understanding to the reader. The form of a device meeting the metes and bounds of the claims may appear different structurally but will have analogous functioning and performing features as disclosed herein.

The prior art is a sheet metal sign attached to a pole (or other supporting structure) with information on only one side of the sign. Often the information is reflective to help night time observation. Often the shape of the sign indicates the nature of the sign. For example, yield signs are triangular and stop signs are octagonal. However, there are many other important signs that to not have a distinctive shape. Many of these are rectangular or circular.

This starts to reveal the problem of the prior art of the traditional sheet metal sign 12. Signs can only be clearly observed from one direction: from directly in front of the sign. From any other angle the nature of the sign, or even the sign's existence, is not readily evident to even a keen observer.

A risky traffic encounter can happen at an intersection of two roads. In a typical example a driver approaches the intersection and sees a stop sign. It is nearly impossible for that driver to ascertain whether the cross traffic is likewise obligated to stop because she cannot clearly see the face of any traffic control signs directed to that perpendicular traffic. Guessing wrong whether the cross traffic will stop has caused many unfortunate accidents and injuries.

Another problem with the prior art is that signs may become faded to the point where legibility is lost. Similarly, at night the face of the signs may not be reflective or have lost the reflective character through exposure to the elements. Being unable to read or detect a sign can cause a significant traffic hazard.

Other problems with prior art signs may include nearby obstructions. For example, trees and other growth can sometimes obfuscate the message intended to be conveyed by the sign. In other locations, the existence of a curved road near the sign or other impediments to a clear display of the face of the sign to oncoming traffic may diminish a driver's ability to benefit from that sign and the improvements to road safety that the sign provides.

The solution lies in how to provide additional and more reliable information to a driver utilizing the existing signage infrastructure to improve traffic safety for vehicles and pedestrians.

Referring now to the drawings, where the present invention is generally referred to with numeral 10, it can be observed that it basically includes a sign 12, a pole 14, a compass 16, a segment 18, a segment 20, a segment 22, a segment 24, a pin 26, a front 28, a back 30, a seam 31, a center 32, a face 33, a notch 34, a tab 35, tabs 36, clips 38, strips 40, strip 41, vehicle 42, surface 43, beam 44, surface 45, road 46, pole 47, intersection 48, pole 49, pole 50, surface 53 and surface 55.

FIG. 1 shows a typical stop sign 12 attached to the top of a pole 14 in turn affixed to the ground. The sign pole cover is generally comprised of a plurality of individual segments stacked vertically around the pole 14. Each of the segments represented by sample segments 18, 20, 22 and 24 encircle the pole 14.

Note the imaginary compass 16 rose floating over the sign 12. Throughout the discussion this compass 16 will help orient the reader to the direction of sight of someone viewing the sign 12 relative to the orientation of the visible surface of the sign 12. For example, in FIG. 1 the face of the sign 12 is parallel to the 270-090 degree axis and the view of the observer from standing in the center of the compass 16 is towards 360 degrees. In other words, in FIG. 1 the 180-360 degree axis is perpendicular to the face of the sign 12. An observer heading at 360 will generally see signs intended for their direction of travel as depicted in FIG. 1. The face of sign 12 is generally perpendicular to the direction of the oncoming observer so that the viewing angle or angle of incidence is approximately ninety degrees relative to the face of the sign 12.

Similarly, those approaching from the right of the sign, bearing 270 degrees in the example in FIG. 1 will only observe the thin profile of the sign 12, effectively a vertical line. This is the sheet metal edge of the sign 12. Conversely, those approaching the sign 12 bearing 090 degrees will only view the vertical edge of the left side of the sign 12, making the sign 12 barely visible from that direction. The directly opposing traffic, from the perspective of an observer from the viewing position as viewed in FIG. 1, bearing 180 degrees, will see the reverse of the sign 12 that is typically not marked and therefore only reveals the shape of the sign.

The precise number of segments 18 stacked on the pole 14 can vary depending on the dimensions of each individual segment and the available vertical space on the pole 14 between the sign 12 and the ground, save any other obstructions on the pole 14. Generally, at least two segments will be effective. Utilizing four to twenty segments has been found to be the most effective for the majority of common road signs. For some applications, more than twenty segments may be useful.

A pin 26 may be placed through the bottom segment and pole 14 to support the stack of segments. This is useful in limiting the stack of segments to an upper portion of the pole. Keeping the bottom segment off the ground can protect it from damage cause by plowing, grounds keeping and other risks of physical damage to the lower segments.

Figure 2:
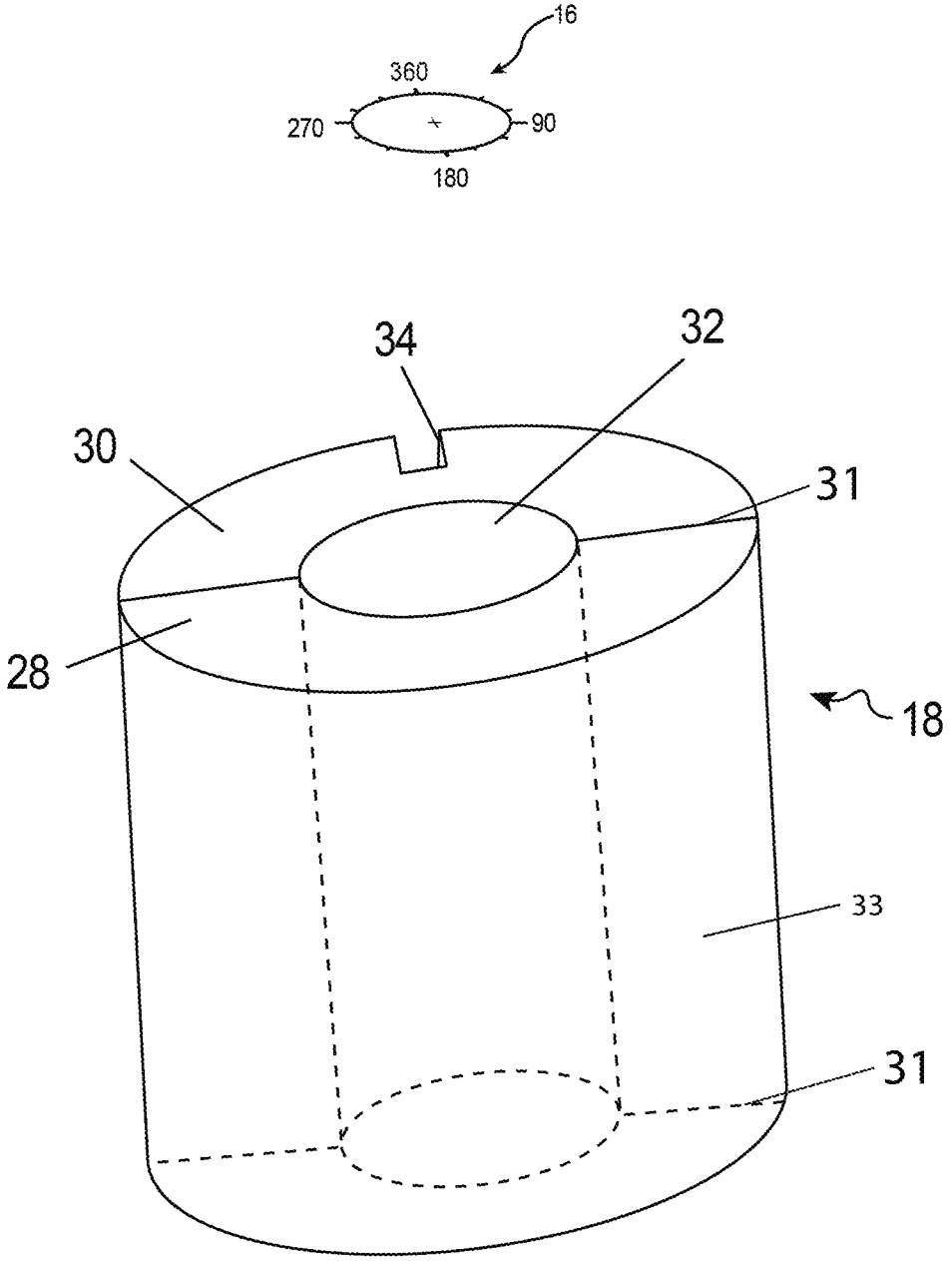
FIG. 2 shows a perspective view of a segment of sign post cover.

Important information can be conveyed to a driver by utilizing a series of segments arranged in specific and predictable patterns. Looking at FIG. 1, the face of the stop sign is red with white text and a white boarder. By having the visible face 33 as depicted in FIGS. 1 and 2 of the segment 18 red, segment 20 white, segment 22 red and segment 24 white, a pattern is made. This red-white-red-white pattern can be repeated on down the pole 14 as far as necessary.

The above is merely one example. Other patterns or combinations of colors may also be used. Consistency of a particular pattern in actual use across a region would be useful for the drivers using those signs to consistently understand the meaning. Generally a standard use would be established by a rule or department of transportation.

Although a stop sign is shown in FIG. 1, the sign post covers can be used with any type of informational or control sign. For example, stop signs, yield signs, one way signs, informational signs, navigation signs and other can all benefit from the present invention.

There may be multiple signs on a pole or multiple poles per sign. Each sign or each pole can have its own designated pattern or colors to convey the intended information.

Pentagonal yellow and black school signs may have a yellow segment 18, black segment 20, yellow segment 22, black segment 24 and continuing. A square blue and white informational sign for a hospital may have a white segment 18, blue segment 20, white segment 22, blue segment 24 and continuing. Rectangular orange and black signs for construction zones could alternate similarly between orange and black or orange and white.

In addition to coloring of the face 33 of any of the segments, the face 33 may also be reflective, retroreflective, prismatic, microprismatic, fluorescence or any other eye-catching surface treatment that aids the viewer in determining the color and pattern of the face 33 or any of the other surfaces on any version of the segments. These visibility enhancements may be directly applied or formed reflective coatings or reflective tapes may be effective.

Figure 3:
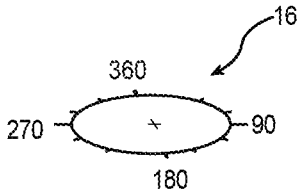
FIG. 3 shows a perspective view of a back section of a sign post cover.
Figure 3:
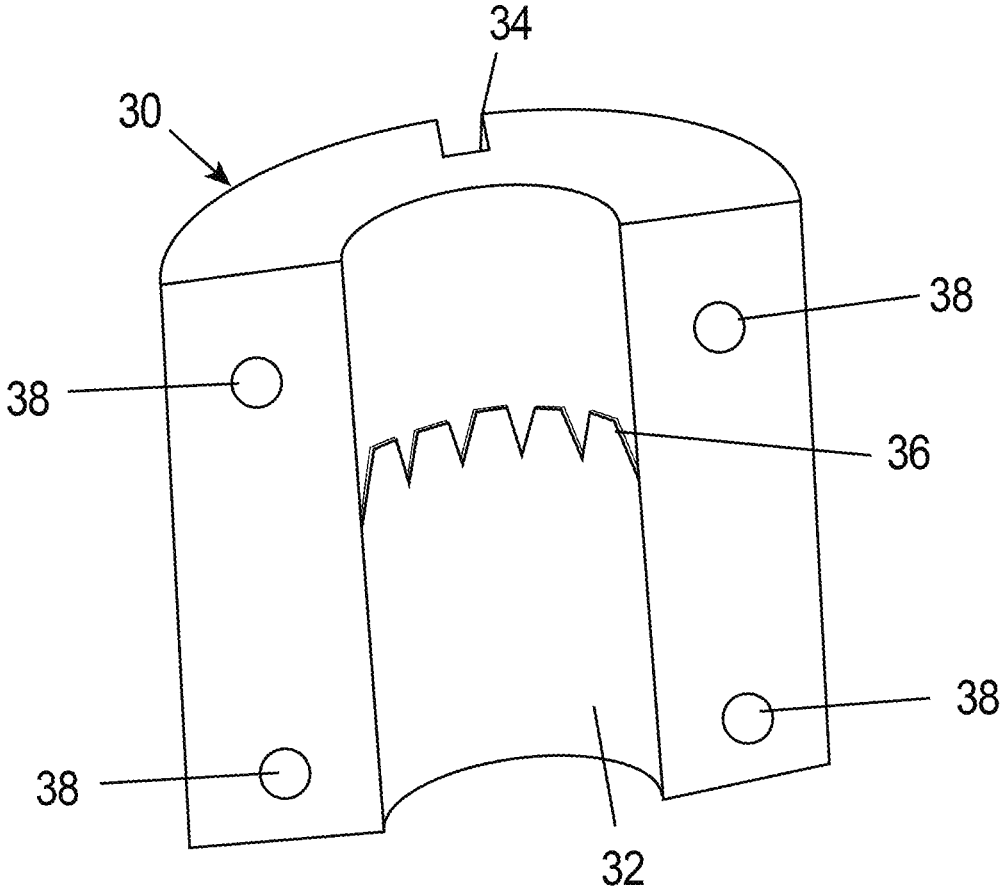
Figure 4:
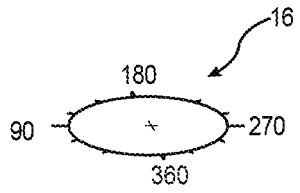
FIG. 4 shows an alternate perspective view of the back section shown in FIG. 3.
Figure 4:
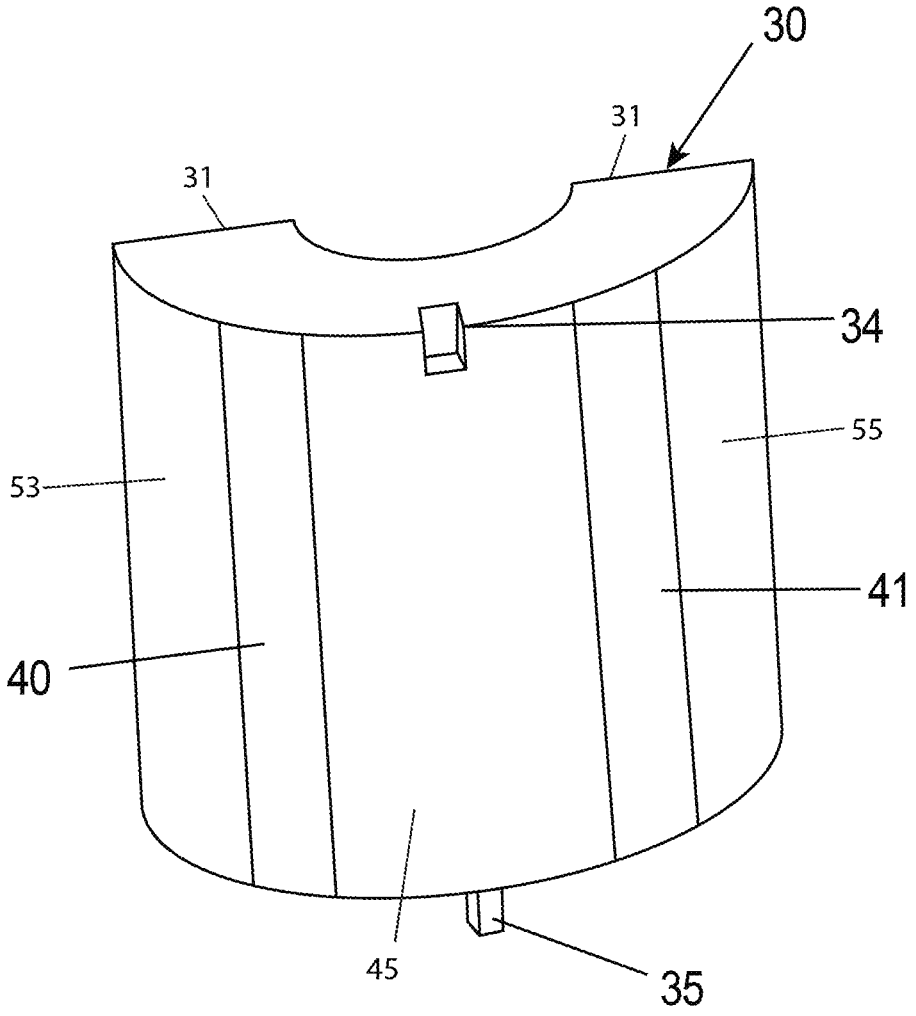

Looking now at FIGS. 2 and 3 where the compass 16 indicates a similar perspective view as that in FIG. 1 of a segment such as segment 18. FIG. 4 is a perspective view of the same segment viewed from about 180 degrees to make visible another side. Generally, the shape of each segment is similar, but this is not required to remain within the inventive concept.

In this adaption of a segment 18 is formed from a front 28 and a back 30. The front 28 and back 30 meet together at a seam 31. The center 32 is generally a cylinder shaped void dimensioned to fit around a pole 14. Because the front 28 and back are separable the segment 18 (and any such adapted segment) can be split and rejoined over the pole 14 without the need to remove the sign 12 and slip the segment 18 over the top of the pole. This is also an advantage when replacing a segment because the entire stack of segments need not be removed to remove only one (or more) segments.

The face 33 generally covers the front 28 half of the segment 18. Inside the center 32 are optionally a ring of flexible tabs 36. These tabs 36 are included to allow the center 32 to hold onto a variety of sized poles 14. This allows the segment 18 to fit on both narrower poles 14 and thicker poles 14 without excessive rattling about the pole 14. Essentially the tabs 36 spring against any size pole 14 ensuring a solid fit. There may be fewer or more tabs 36 than shown. There may be more than one annular series of tabs 36.

To secure the front 28 to the back 30 a set of clips 38 may be provided on the mating faces between the front 28 and the back 30. In the example in FIG. 3 the clips 38 on the back 30 are fit into a corresponding clip on the front 28. In an equally viable version the front 28 and back 30 may be joined by any of a wide variety of attachment means. For example, adhesives, screws, toggles, dovetails, raceways, magnetic hasps, wire ties or any other known attachment means.

In a version of a segment 18 (and other segments) the front 28 and back 30 may be hinged together along an outside vertical edge. This has the advantage of keeping mating fronts 28 and backs 30 together prior to installation onto a pole 14. The hinge would obviate the need for the clips 38 on one side of the device. A hinge could readily be molded into the segment by plastic molding the front 28 and back 30 in one piece during the fabrication process.

Although the tabs 36 can help the face remain oriented facing the same direction as the face of the sign 12, there may need to be other features to keep this orientation of the segments 18 in line. The pin 26 can help align the face 33 so that it is fully visible from a driver approaching the face of the sign 12.

The several segments can also be aligned to each other by connecting or indexing to the segment above or below so that when the face 33 of one of the stack of segments is facing the same way as the sign 12 then all the segments are facing the correct direction. One possible means to index a segment to an adjacent segment is with a notch 34 on one segment that can fit over a tab 35 on an adjacent segment. In the example in FIG. 4, the notch 34 is on one side of the back 30 and the tab 35 is on the other side of the segment. In this way one segment can be rotatably aligned with the other segments of the stack. There are many other ways to hold the stack of segments in line so that the face 33 of each segment is directed in the same direction as the face of the sign 12 that could be equally effective and remain within the inventive concept. For example, adhesives, pins, clips, the shape of the pole 14 matching the shape of the center 32 or other means could all be used to keep the face 33 aligned with the direction the sign 12 is facing and all of the individual segments of the stack aligned uniformly together.

The reverse of a segment is clearly shown in FIG. 4 to include a central surface 45 bounded by vertical strips 40 and 41. Surface 53 is adjacent to seam 31 and bounded by strip 40. Surface 55 is adjacent to the other side of seam 31 and is bounded by strip 41.

Strips 40 and 41 also act as indicators and are located on the back 30. In the version shown in the drawings the strips 40 and 41 are vertical. A surface 45 separates the strips 40 and 41 so that they are visibly distinct from each other and appear as a separated pair of strips 40 and 41. A surface 55 separates the face 33 from strip 40 on the right. A surface 53 separates face 33 from the strip 41 on the left.

Strips 40 and 41 are used to give a visual clue as to which side of the sign an observer is positioned. Strips 40 and 41 should be easily distinguishable from the face 33. Strips 40 and 41 may be colored and reflective similar to the means by which the face 33 is colored and reflective.

The colors of the strips 40 and 41 and surfaces 45, 53 and 55 may be coordinated with the color of the face 33. Following the example above where a stop sign is used with ascending segments alternating white and red, the strips may use similar colors. Continuing the example, for a segment with a red face 33, the strips 40 and 41 could also be red and the surfaces 45, 53 and 55 between the strips 40 and 41 could be white or absent of color. For the white face 33 segments the strips 40 and 41 could be white as well with the intervening surfaces 45, 53 and 55 either red or not colored or not reflective.

The specific color scheme is not as critical as the idea that the color schemes are used consistently throughout a region so that drivers can observe, understand and appropriately respond to the additional available information provided by the pattern produced from a stack of alternating colored segments.

Other orientations of the strips 40 and 41 are also viable options. There may be a single, vertical strip 40 on the center of the back 30 or there may be several strips on the back. The strip or strips on the back could be horizontal or arranged in another angular or geometric pattern or configuration. Circles, wavy lines or other looks could also be effective as long as the face 33 of the segment is facing the same direction as the sign 12 above and can be distinguished from the back 30 so that an observer can know from which side of the sign 12 they are approaching from.

Strips 40 and 41 may be reflective, high contrast, fluorescent, colored and/or with other visually noticeable characteristics. Similarly, the surfaces 45, 53 and 55 may be reflective, high contrast, fluorescent, colored or with any visually noticeable characteristics and are preferably distinct from the strips 40 and 41 or their equivalent or optional forms as described above. Surfaces 45, 53 and 55 may also be non-eye-catching in flat, dull, color, sheen or non-reflective looks.

Looking now at FIGS. 5 through 10, a working example is shown. Generally in FIG. 5 a traffic scene is depicted from above and details are expanded in FIGS. 6 through 10. Note the compass 16 to understand the orientation of the stacked segments on the various poles.

The vehicle 42 is approaching the intersection 48 bearing 360 degrees. The beam 44 of the vehicle 42 headlights shine towards the intersection 40 in the same direction and from the same perspective as the driver observes the face of the sign affixed to pole 14. The sign 12 has been omitted from FIG. 5 but is intended to span from 270 to 090 degrees with the face at 180 degrees. From the perspective of the vehicle 42 a segment on pole 14 would appear like in FIG. 7 with the full face 33 exposed towards the observer in the vehicle 42. With the full face 33 visible of each of the stack of segments the driver knows that she is approaching that sign 12 intended to control her vehicle.

At the same time, the observer-driver in the vehicle can see the segment stack on the pole 50 that has a sign facing a driver on a bearing of 180 degrees, essentially head on to the vehicle 42. In this situation the driver in vehicle 42 could only see the reverse of the sign 12 affixed to the top of pole 50 and the back 30 of the stack of segments that would appear to be as the segment in FIG. 10.

Figure 9:
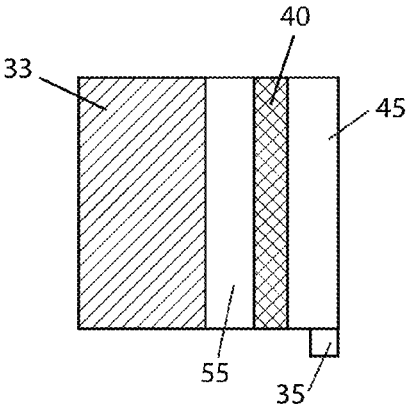
FIG. 9 shows an elevation view of a right side of a sign post cover.
Figure 10:
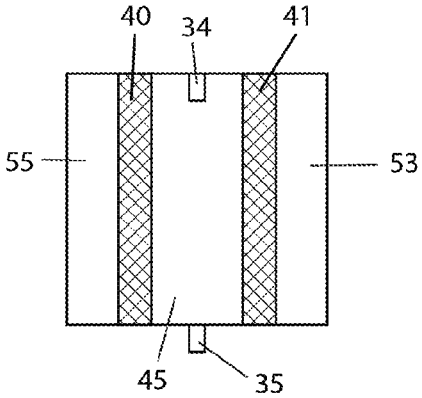
FIG. 10 shows an elevation view of a rear side of a sign post cover.

Yet again from the perspective of the driver of vehicle 42, the sign on pole 49 that is intended to control the lane crossing that vehicle's 42 path from left to right on a bearing of 090 degrees would display segments appearing like that shown in FIG. 9. From this perspective the driver of the vehicle 42 would see the solid face 33 on the left side of each segment and the strip 40 on the right bounded by surfaces 45 and 55.

Figure 8:
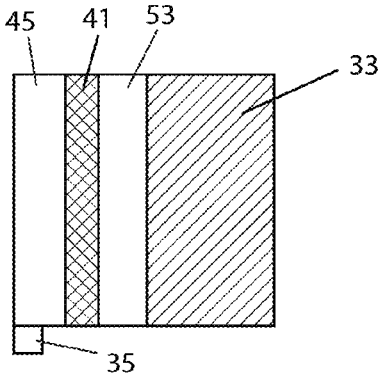
FIG. 8 shows an elevation view of a left side of a sign post cover.

From the perspective of the driver of vehicle 42, the sign on pole 47 that is intended to control the lane crossing that vehicle's 42 path from right to left on a bearing of 270 degrees would display segments appearing like that shown in FIG. 8. From this perspective the driver of the vehicle 42 would see the solid face 33 on the right side of each segment and the strip 41 on the left bounded by surfaces 45 and 53.

Figure 5:
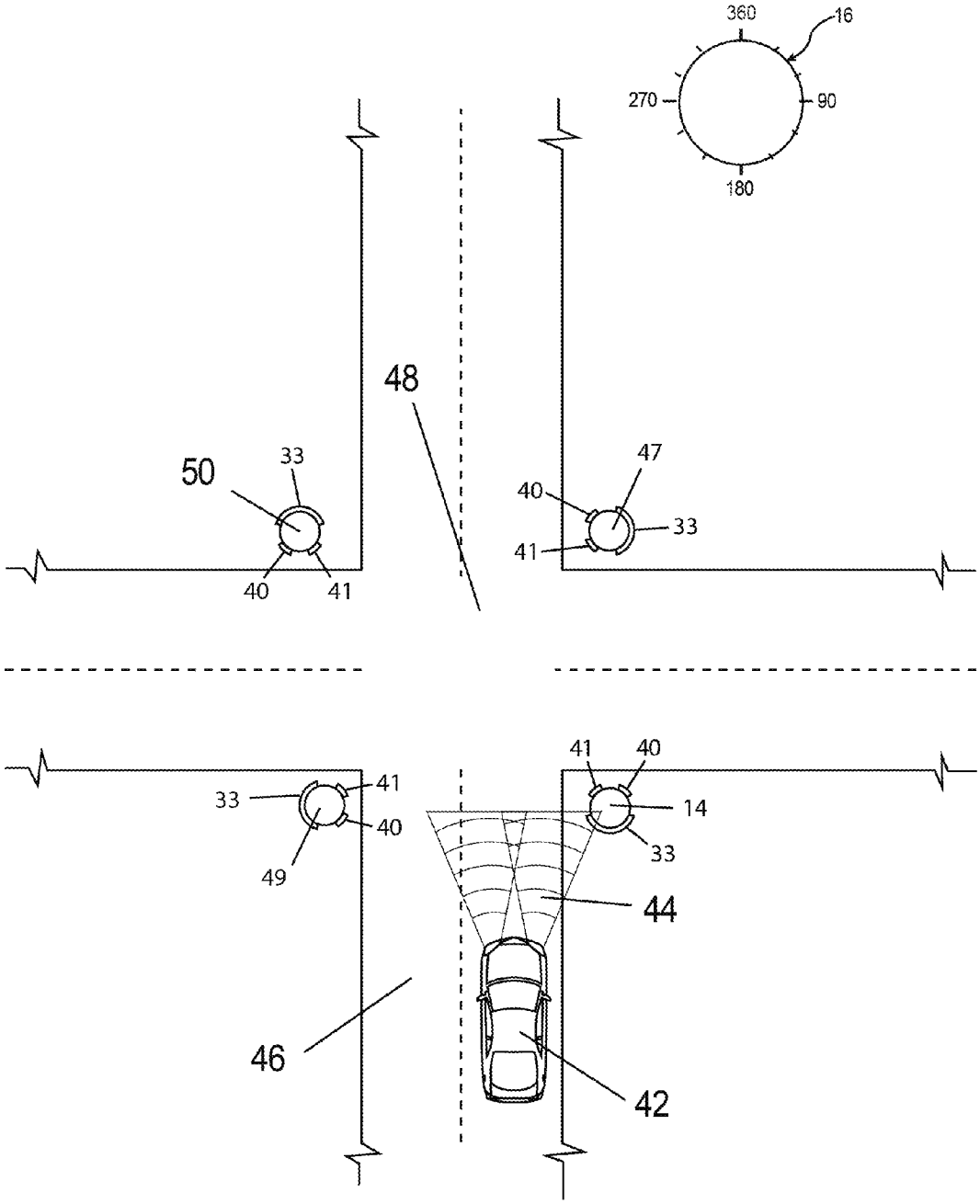
FIG. 5 shows a plan view of a roadway intersection.
Figure 7:
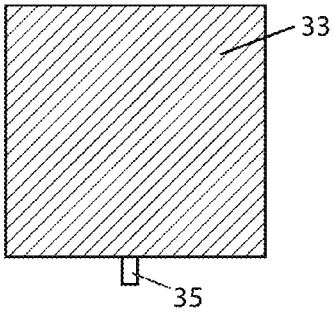
FIG. 7 shows an elevation view of a front side of a sign post cover.

The impact of this example is that if the driver of the vehicle 42 on the road 46 approaching the intersection 40 has a sight picture like FIG. 7 for each of the stack of segments then she knows that sign is to control her vehicle 42. The colors or pattern indicate what the message of the sign 12 is conveying, for example to stop before entering the intersection. At the same time the driver sees a sign picture like FIG. 10 on each segment in the stack on pole 50 in the opposing lane and recognizes the color pattern then she knows that head on traffic must also stop before entering that intersection. Still at the same time she sees on her left that traffic entering the intersection 48 from that direction will see the face of the sign on pole 49 with a sight picture like FIG. 9 with the pattern of a stop sign (red-white-red-white . . . stack of segments) that that car must also stop before entering the intersection 48. Likewise when she sees on pole 47 the segments looking like in FIG. 8 with the properly colored pattern she knows that the car heading towards the intersection 40 from the right to her left must also stop before entering the intersection 48. In this way she can determine whether it is a four way stop, as shown in FIG. 5, or some other traffic control pattern.

Figure 6:
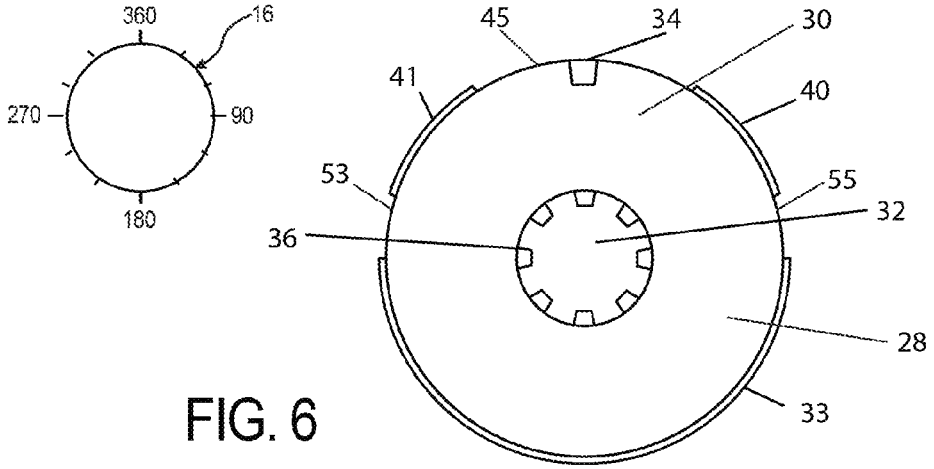
FIG. 6 shows a plan view of a sign post cover.

Looking specifically at FIG. 6, an important concept in the present invention is that the face 33 of the segments span clockwise from about 090 to 270 degrees. The face 33 is positioned to be facing the same direction as the sign 12 onto which the segment is associated. The exact nature of the visual information is not critical as long as it is consistently used so that drivers can recognize it as being on the face side of the sign 12 from whatever direction they approach that sign 12. Further, the back 30 has a different pattern, for example strips 40 and 41 that are positioned between 270 degrees clockwise to 090 degrees. However, other patterns on the back 30 could be effective if the driving public can consistently recognize that those markings indicate the reverse of the sign 12.

Autonomous cars or those utilizing computer controls with electronic imaging equipment may be adapted to "see" the nature and orientation of traffic control signs better with a predictable scheme of color patterned segments on the pole. A mobile eye like this on cars will be much better at understanding signs and to which vehicles those signs apply. Even if not fully autonomous, driver assist during day or night driving can alert a driver to the existence of signs near the car that affect that car or other nearby traffic. The pattern of the segments, their faces and strips can convey significant information to the vehicle and its driver. Further information could also be conveyed by adding readable codes onto any of the segments, such as a QR, barcode, RFID, NFC chips or other available non-contact means to convey information.

The nature of the segments being clam shelled or separable into halves can allow an easy retrofit of current sign inventory to add the sign post covers. For the same reasons, repairing broken or worn out segments can also be easily done with minimal man power and in a short amount of time without removing or reinstalling the entire sign and post to put new segments in place Generally, the segments may be made of a durable material such as plastic or metal. The segments are preferably weather resistant and will resist damage from the sun. But if they are damaged, they are individually replaceable.

A version of the invention can be fairly described as a sign post cover comprising a plurality of individual segments stacked on the sign post. Each individual segment is generally cylindrical and has a top, a bottom and an exterior surface. Alternatively the segments could have other shapes such as prisms (of any geometry), sphere, pyramid or other shape that can be defined as having a front and a back viewing sides. Each individual segment has an open center along an entire longitudinal axis dimensioned to fit around a predetermined sign post. The exterior surface is comprised of a face side and rear side each covering about a half of the exterior surface. The front and back are separated by an imaginary vertical line about on the same plane as the sign above. The face side is completely covered with a predetermined first or second visual configuration. In some applications there may be more than two, alternating configurations of the face sides of the segments. For example, repeating red, white and black configurations (or other color or pattern scheme) may be useful to convey messages to the drivers or automated vehicles). The back side is partially covered with a predetermined third visual configuration. For example and as seen in the drawings the third visual configuration may be vertical stripes. A sign having a face is affixed to the sign post, generally at the post's upper end. The face of the sign is oriented in a direction, typically in the direction towards the traffic it is intended to control. The plurality of individual segments are positioned stacked around a preselected traffic control sign post alternating between individual segments with the first and second visual configuration. The face side of the segments are oriented centered in the same direction of the face. The segments may be comprised of a first half and a second half selectively separable about a longitudinal plane where the exterior surface of the first half is the face side and the exterior surface of the second half is the rear side. This could use a hinge between the front and back halves or the halves could be completely separable and attach together around the pole to complete each segment. An interior wall of the open center may have flexible tabs that bias toward an axial centerline of the open center. This can more firmly secure the segment to the pole and also allow the segments to adapt to varying sizes of poles. The first and second visual configuration may be a preselected reflective solid color and the third visual configuration includes a reflective element, such as vertical stripes or other visual configuration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sign post cover comprising a plurality of individual segments;

the individual segments are supplied in a first type and a second type;

each individual segment is cylindrical and has a top, a bottom and an exterior surface;

each individual segment has an open center along an entire longitudinal axis dimensioned to fit around a predetermined sign post;

the exterior surface is comprised of a face side and rear side each covering half of the exterior surface;

the face side of the first type segments are completely covered with a predetermined first visual configuration;

the face side of the second type segments are completely covered with a predetermined second visual configuration;

the back side of first type segments are partially covered with a predetermined third visual configuration;

the back side of second type segments are partially covered with a predetermined fourth visual configuration;

a sign having a face is affixed to the top of the sign post;

the face of the sign is oriented in a direction;

the plurality of individual segments are positioned stacked around a preselected traffic control sign post alternating between individual first type segments and second type segments;

the face side of the segments are oriented centered in the same direction as the face of the sign so that a vehicle approaching the face of the sign sees only the first and second visual configurations and a vehicle approaching opposite the face of the sign sees only the third and fourth visual configurations and a vehicle approaching from a side of the face of the sign will see partially each of the first, second, third and fourth visual configurations.

2. The sign post cover in claim 1 further characterized in that each segment is comprised of a first half and a second half selectively separable about a longitudinal plane where the exterior surface of the first half is the face side and the exterior surface of the second half is the rear side.

3. The sign post cover in claim 1 further characterized in that affixed to an interior wall of the open center is a flexible tabs that bias toward an axial centerline of the open center.

4. The sign post cover in claim 1 further characterized in that the first and second visual configuration is a preselected reflective solid color and the third and fourth visual configuration includes a reflective element.

* * * * *